United States Patent [19]

Guery et al.

[11] Patent Number: 4,631,507

[45] Date of Patent: Dec. 23, 1986

[54] VARIABLE COMPOSITION SWITCHING DEVICE

[75] Inventors: Jean-Pierre Guery, Bezons; Gerald Gashet, Puteaux; Jacques Olifant, Nanterre; Raymond Plumeret, Asnieres, all of France

[73] Assignee: La Telemecanique Electrique, France

[21] Appl. No.: 780,772

[22] Filed: Sep. 27, 1985

[30] Foreign Application Priority Data

Sep. 27, 1984 [FR] France ..... 84 14826

[51] Int. Cl.[4] ..... H01H 73/00; H01H 77/02

[52] U.S. Cl. ..... 335/27; 335/173; 335/174; 335/175; 335/186; 335/189; 335/190

[58] Field of Search ..... 335/185, 186, 189, 190, 335/200, 164, 165, 166, 173, 174, 175, 26, 27

[56] References Cited

U.S. PATENT DOCUMENTS 3,201,545 8/1965 Kruzic ..... 335/165

*Primary Examiner*—E. A. Goldberg
*Assistant Examiner*—Lincoln D. Donovan
*Attorney, Agent, or Firm*—William A. Drucker

[57] ABSTRACT

A variable composition switching device which comprises one basic modular component incorporating at least one controllable switching device, one direct switching control modular component and/or one indirect switching control modular component. This indirect switching control component acts on the basic modular component through a potential energy accumulation tripping device.

17 Claims, 12 Drawing Figures

VARIABLE COMPOSITION SWITCHING DEVICE

BACKGROUND OF THE INVENTION

1. Field of the Invention

The present invention concerns a variable composition switching device that involves particularly:

on one hand, one or several switching devices, each one of which comprises at least one fixed contact unit, at least one mobile contact unit assembled on a mobile element designed to take at least two positions, i.e. one first position wherein the mobile contact unit is applied against the fixed contact unit (closed condition) and the second position wherein the mobile contact unit is separated from the fixed contact unit (open condition), and elastic means which exert a pull on the mobile element in order to make the mobile contact unit return to one or the other of the aforementioned positions, and on the other hand, at least one control and/or protection device capable of causing a change of state of the switch, by exerting on the mobile element an antagonistic action which counteracts the pull of the elastic means.

2. Description of the prior art

Various control and/or protective devices may be used in this type of switching devices; they may namely consist in:

manual control devices, automatic control devices, e.g. involving electromagnets, protective means that cause automatic switching of the interrupting device on the occurrence of disturbances in the current applied to the contact units.

These control and/or protective devices are usually designed so that the circuit-opening device switching is compatible with the function at hand.

For instance, in the case where the interrupting device is of the normally closed type, protective devices against overcurrents e.g. due to short-circuits, must be designed to induce rapid current breaking, to avoid damage to the contact units from the breaking arc.

To obtain high breaking speeds, two types of measures can be considered, whether separately or together.

The first type of measures consists in increasing the force applied by the control and/or protective device involved; however, if the resistant strength of the mobile element of the switch is high, this can lead to oversizing the control device and its associated components.

The second type of measures consists in minimizing the resistant strength of the mobile element:

by lowering the stiffness of the elastic means associated with the mobile element; however, in the case of a normally closed type switch, this can only be achieved at the expense of the quality of the electric contact in the closed position, and/or by limiting inasmuch as possible the number of current-breaking devices associated with a single control device and decreasing the inertia of the mobile elements of these current-breaking devices, mainly by reducing the number of mobile contact carried by the mobile elements.

It is apparent that these measures oppose the variable compositon principle proposed for the switching device described, which implies the possibility of multiple associations of elementary functions, and particularly the control of several switches, each one of which may comprise a variety of fixed and mobile contact elements, by a single control and/or protective device that requires high breaking speed.

OBJECT OF THE INVENTION

The purpose of the invention is to eliminate the drawbacks listed above. It has for its object a variable composition switching device involving a set of modular components that can be assembled together to construct different switching functions, such as a switch, a contactor, a contactor breaker, whereas the said set of components includes on one hand at least one basic modular component incorporating a controllable current-breaking device featuring:

at least one fixed contact unit, one mobile element carrying at least one mobile contact unit and able to move between two positions, i.e. one position in which the mobile contact unit is in contact with the fixed contact unit, and one position in which the mobile contact unit is separated from the fixed contact unit;

elastic means acting on the mobile carriage with a force that tends to make it return to one of the two aforementioned positions, and one driving part rigidly attached to the mobile element or of a block with it, whereas this driving part features at least one bearing surface upon which a command force, antagonistic to the action of the elastic means can be exerted to move the mobile element into its second position, and on the other hand, at least one of the following modular components:

one direct switching control modular component, including a direct action actuator able to exert on the bearing surface of at least one basic module a fast enough driving action with sufficient force to ensure proper switching of the switching device, and an indirect switching control modular component, including an actuator which, in response to a command which is too slow and/or has insufficient energy to ensure proper switching, acts on the bearing surface of at least one basic modular component by means of a potential energy accumulation tripping device.

SUMMARY OF THE INVENTION

In accordance with the invention, this device is more specifically defined by the fact that the potential energy tripping device can have two stable states, i.e. one 'reset' state and one 'tripped' state, as well as two transient phases, i.e. one setting phase and one tripping phase, whereas the tripping device includes:

an actuator device that can successively take two stable positions pertaining to the two states described above, i.e. one tripped position whereby it exerts upon the bearing surface of the driving part of the current breaking device an antagonistic action to that of the elastic means in order to ensure that the mobile element remains in the second position, and one reset position whereby it enables the return of the mobile element to its first position;

a potential energy accumulation system capable of storing potential energy during the setting phase and of returning it during the tripping phase, in the form of mechanical energy applied on the actuator to cause the mobile element to move from the first to the second position;

a setting device, involving at least one setting part upon which energy can be applied during the setting phase and a setting mechanism designed to cause the actuator device, under the influence of the said energy, to move from its tripped position to its reset position, and at the same time to transmit part of the said energy to the accumulation devices, and a tripping unit involving at least one tripping part upon which at least one command action can be applied to induce the tripping phase, whereas this command action can be produced by one or several control and/or protective devices designed to cause a sudden change of state of the switch.

Mention should firstly be made of the fact that in the device described hereabove the commands issued by control units which generate a signal with enough energy and speed to ensure proper switching of the switching device act directly upon a bearing surface of at least one basic module. This action can be exerted directly or by means of a mechanical transmission device, in the understanding that in both cases it is the force exerted by the modular control component which is used to ensure the switching. This is the reason why this type of control elements have been called direct switching control modular components.

Conversely, commands issued by control elements which generate control orders with insufficient energy and/or speed act on the bearing surface of the basic module or modules through the aforementioned tripping device which, using only the previously accumulated potential energy, causes the tripping. This is why these control elements have been called indirect switching control modular components.

It should also be pointed out that during the setting phase, the storage of the potential energy to be used during the tripping phase takes place during or immediately after the transfer of the setting devices from the tripped position to the reset position and therefore independently from the switch, the mobile element of which is then only attracted by the elastic means associated with it. Likewise, the amount of potential energy accumulated is not restricted by the mechanical characteristics of a particular switch. As a result, it is possible to use a single instantaneous tripping device for several switches, by adjusting the stored potential energy at the desired level, and of course by using suitable mechanical transmission means between the tripping device actuator and the bearing surface of the driving part of these switches.

Likewise, in the case where the tripping part belonging to the tripping device is associated with several control and/or protective devices, it is also possible to provide for suitable mechanical transmission means to convey the control action from these devices to the aforementioned tripping device.

In addition, the operating force applied on the bearing surface of the driving part of each one of the switches can be the result of a direct action from one or several control devices, which are able to act on one or several switches. In the latter case, it is possible to provide for the rigid mechanical coupling of the driving parts of all the switches.

As mentioned hereabove, the switching device may involve one or several switches of the same type or of different types. These switches may be of the normally open type or of the normally closed type. Each switch may include one or several couples of mobile and fixed contact units, each of which can act as a normally closed and/or normally open type switch.

In a particularly attractive embodiment of the invention, the aforementioned switch, the tripping device and the different control devices are each contained in separate housings that can be assembled together as required to construct the switching device wanted.

BRIEF DESCRIPTION OF THE DRAWINGS

Different implementations of the invention are described hereinafter, as non restrictive exemples, referring to the attached drawings wherein.

DESCRIPTION OF THE PREFERRED EMBODIMENT

Figure 1:
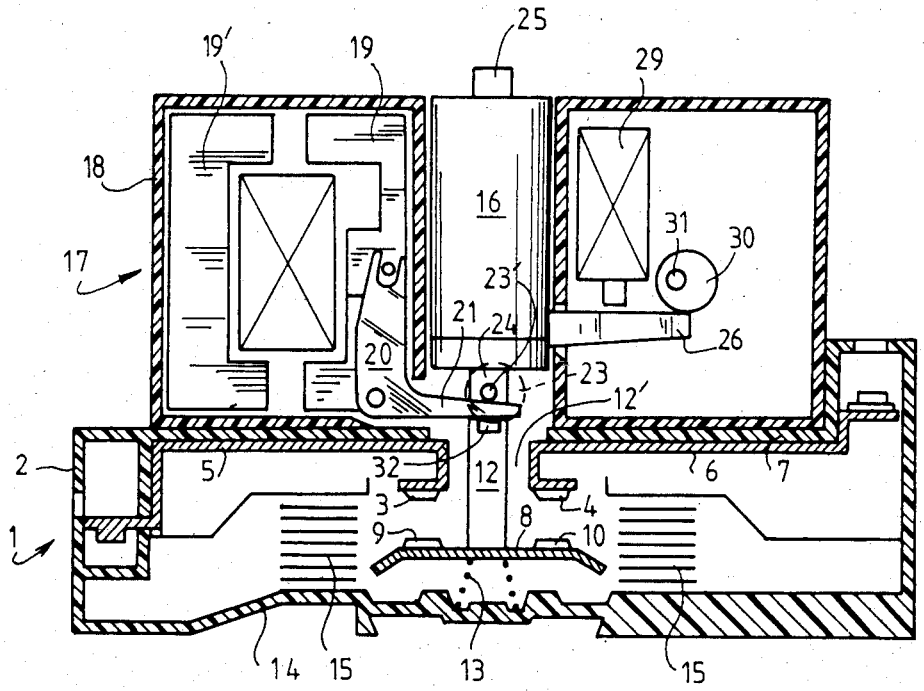
FIG. 1 is a schematic cross-section of a switching device designed according to the invention, acting as a high breaking capacity contactor-breaker.

In the example shown in FIG. 1, the switching device comprises in the first place a controllable switch 1, contained inside housing 2, and conventionally including:

two fixed contact units 3, 4 supported by two conductors 5, 6, each fastened to the top 7 of the housing 2;

a mobile element involving a mobile contact-bearer 8 made of electrically conducting material, on which are assembled two mobile contact units 9, 10 designed to meet with the matching fixed contact units 3, 4;

an operating device consisting of a rod 12, made of electrically insulating material, solidly fixed to the mobile contact holder 8, and passing through the hole 12' provided in the top 7 of the housing 2, in the space between the two fixed contact units 3, 4, and a spring 13, located between the bottom 14 of the housing 2 and the mobile contact-holder 8, designed to exert a force that tends to pull mobile contact units 9, 10 towards fixed contact units 3, 4.

Of course, this switch can additionnally include all the items which are usually provided on switches such as for instance arc splitting fins 15, arc chutes, etc . . . On the other hand, conductors 5 and 6 are folded back to aid in the development of repulsion forces acting on the mobile contact-holder 8 under the effect of the current flowing in the switch.

It is obvious that owing to the action of spring 13, this switch is in a normally closed position, and that the switch may be opened by subjecting operating rod 12 to an axial pressure antagonistic to the effect of spring 13.

As mentioned above, there are two different types of opening operation for this switch 1, i.e. operation known as conventional, which does not require the instantaneous opening of the circuit, and operation requiring high breaking speed, for instance to avoid damage to contact units 3, 4, 9, 10 by the current breaking arc. The former type of operation is ensured by direct control action on pushrod 12, whereas the second type of operation is obtained by means of a potential energy storage tripping device 16.

In the example described in FIG. 1, the first type of operation control is simply illustrated by the electromagnet 17 located inside a housing 18, the mobile armature of which 19 is coupled with an oscillating lever 20 of which one arm 21 emerges from housing 18 and cooperates with the operating rod 12 as follows:

In its excited state, the electromagnet mobile armature 19 presses against the fixed armature 19', causing lever 20 to swivel; the latter leaves the stop 32 and releases push button 12; under the effect of spring 13, mobile contact units 9, 10, supported by contact holder 8, travel and make contact with fixed contact units 3, 4, and the switch is then in the closed state.

As soon as current stops flowing in the electromagnet coil, the mobile armature 19 which is pulled back by a spring (not shown in the drawing) moves away from the fixed armature 19'; lever 20 then swivels, pushing back operating rod 12 and counteracting the effect of spring 13, and causing mobile contact units 9, 10 to move away from fixed contact units 3, 4; the switch is then in the open state.

Of course, the invention is not restricted merely to this first type of operation control. In this connection, switch 1 could also be operated by a manual or automatic control device acting directly or through a transmission mechanism on the operating rod. One such transmission mechanism could involve, as the drawing shows in dashed lines, a cam 23 or similar, assembled on a rotary shaft 23', the circular movement of which is controlled by one or several control devices. Besides, it should be mentioned that the shaft 23' can hold several cams, each cooperating with the pushrod of a corresponding switch.

As for the second type of controls, they involve a potential energy accumulation tripping device 16 which comprises, as shown in FIG. 1, an actuator 24 located in front of operating rod 12, a resetting pushrod 25 and a tripping device 26.

As we shall explain in more detail in connection with FIGS. 2 to 5, in the reset position of tripping device 16 the actuator 24 is retracted, and in this position it does not act on operating rod 12, allowing switch 1 to be closed. As from this position, the tripping phase is obtained by tilting the tripper 26 under the effect of a control action (arrow 27). This tilt causes the actuator 24 to stretch out violently and to impel operating rod 12, resulting in the high-speed opening of switch 1.

Figure 2:
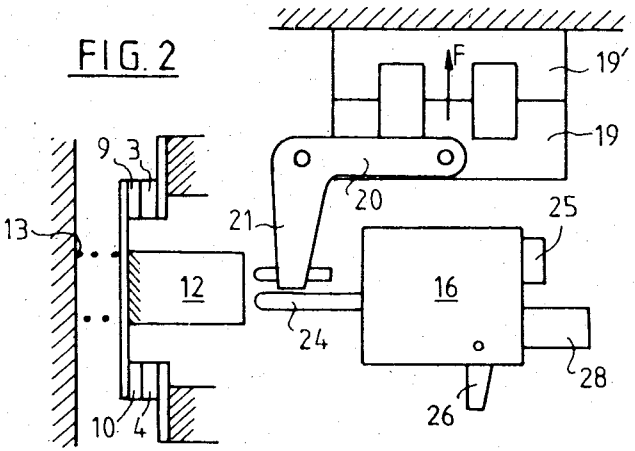

In the example illustrated in FIG. 2, the electromagnet is energized and tripping device 16 is in its reset condition, in which the actuator 24 is retracted, whereas the resetting push-button 25 is depressed. Consequently, operating rod 12 of switch 1 is not subjected to any external force, and therefore the mobile element pulled by spring 13 is positioned in the closing position.

It should be pointed out that in this example the tripping device comprises a stop pushrod 28, near the resetting push-button 25, which can take two positions opposite to those of resetting pushrod 25, i.e.:

an extended position whilst reset button 25 is depressed, and a depressed position when reset button 25 is released.

Depressing this stop button 28 from its released position causes the tripping device 16 to move into its tripped position.

As mentioned above, a control action exerted on the tripping lever 26 in the direction of arrow 27 causes the tripping device to move into the tripped position. During the tripping phase, under the effect of the potential energy stored in the tripping device 16, the actuator 24 moves violently into its extended position, impelling operating rod 12, and consequently causing switch 1 to take up its open position. At the same time, setting pushrod 25 stretches out to its extended position, whilst the stop pushrod 28 is depressed (FIG. 3).

Figure 3:
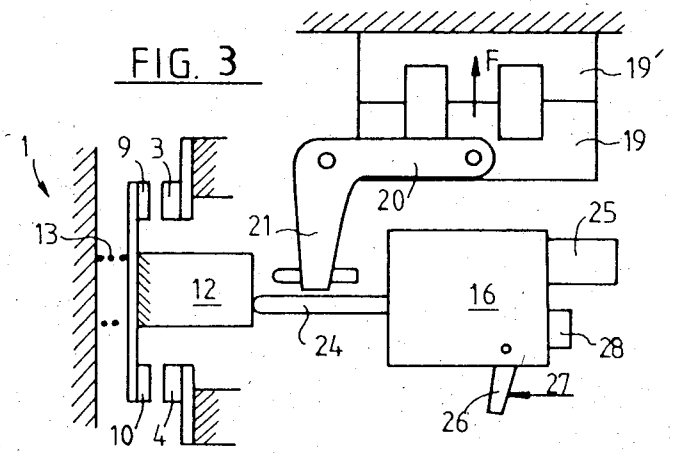
FIGS. 2 to 5 are schematic illustrations of the operation of a switching device such as the one pictured in FIG. 1.
Figure 5:
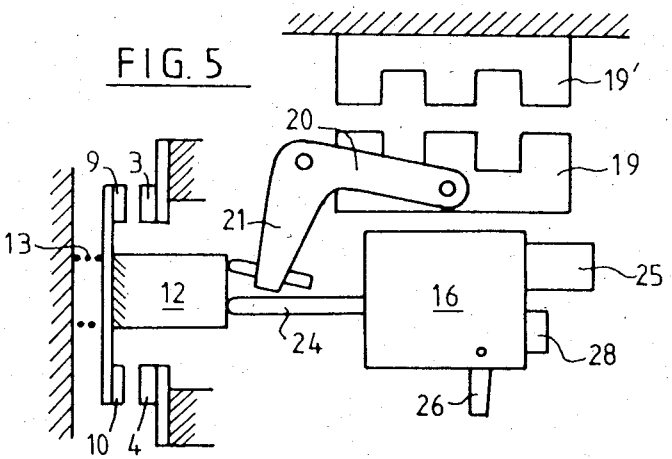

In this position, the electromagnet can remain energized and stay in the position shown in FIGS. 2 and 3. However, the tripping device 16 may also cause the opening of an auxiliary contact designed to interrupt the power supply to the electromagnet coil when it is in the tripped state. In this case, the opening of switch 1 by the tripping device is confirmed by the action of lever 20 bearing on operating rod 12, as shown in FIG. 5.

The return of the tripping device 16 to its reset position is obtained by exerting manual pressure—or automatic pressure if applicable—on reset pushrod 25, and causing it to be depressed.

This action results in the return of stop pushrod 28 to its raised position, the return of the actuator 24 to its retracted position, and the accumulation of a specific amount of potential energy designed to be applied on the actuator 24 during the tripping phase.

When in the reset position, the tripping device 16 does not oppose any operating control action exerted directly on pushrod 12 of switch 1. As a result, for instance, the electromagnet will be able to act independently on switch 1 causing it to open or close as applicable.

Figure 4:
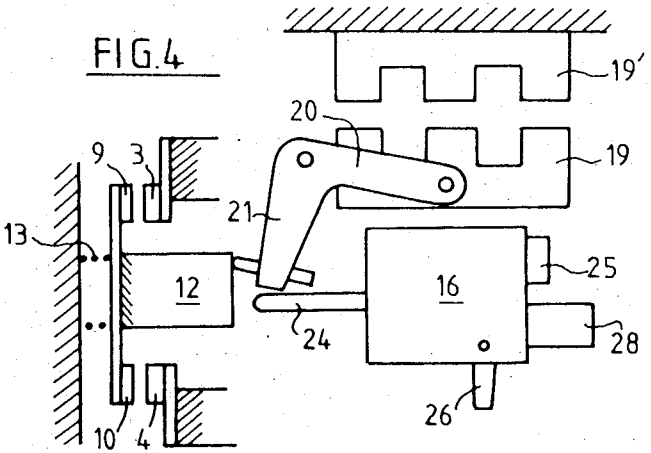

In the example shown in FIG. 4, the tripping device 16 is in the reset position, whereas the electromagnet is not energized. In this position, owing to the pull of the spring, the mobile armature 19 of the electromagnet is separated from fixed armature 19' and has tilted lever 20, the top of the arm of which 21 then bears on operating rod 12 and thus retains switch 1 in the open position.

In the example illustrated in FIG. 1, control of the tripping lever 26 in tripping device 16 is ensured on one hand by an electromagnet 29, which is part of a protective device, e.g. against heavy overcurrent surges or short-circuits, and on the other hand by a transmission device involving a cam 30 which cooperates with tripper 26, assembled on a rotary shaft 31 the rotation of which can be driven by one or several control devices designed to cause instant opening of the switch. In this connection it should be noted that these control devices can act both on tripper 26 and on pushrod 12 of switch 1 or the transmission device 23, 23' associated therewith.

Figure 6:
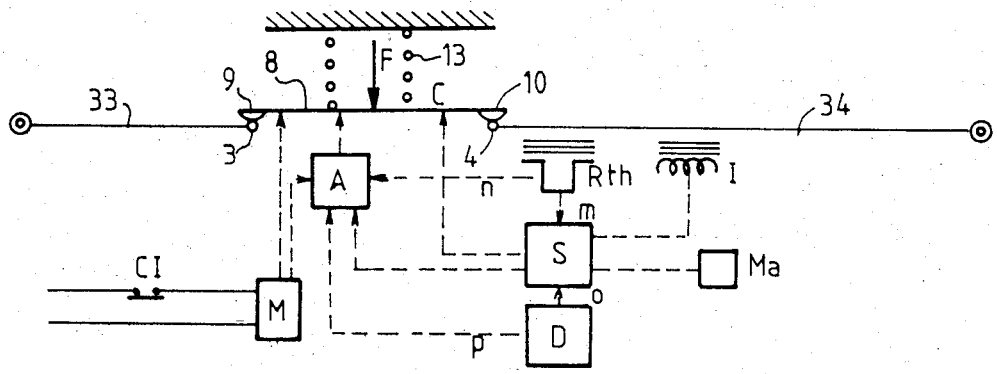
FIG. 6 is an electro-mechanical diagram of a contactor such as the one pictured in FIG. 1.

FIG. 6 is a theoretical diagram for a high breaking capacity contactor which can be designed on the basis of a structure such as the one illustrated in FIG. 1.

Figure 7:
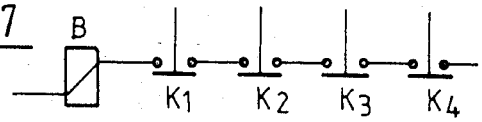
FIG. 7 is a diagram of the supply circuit to the electromagnet coil used in FIG. 6.

In this example, the switch comprises at least two fixed contact units 3, 4, connected to both parts 33, 34 of a power transmission line. Both fixed contact units 3, 4, are associated with two mobile contact units 9, 10 assembled on a mobile contact holder 8 pulled back by a spring 13 which applies a force F that tends to close the switch. The switch can be caused to open by various means, all of which are able to subject the mobile element 8 to a force antagonistic to and stronger than that exerted on it by spring 13. In this example, the aforementioned means more specifically involve:

an automatic control device A that could consist in the electromagnet shown in FIGS. 1 and 2 to 5; this control device may also include four auxiliary contacts $K_1$, $K_2$, $K_3$ and $K_4$ mounted in series in the power supply circuit to the electromagnet coil B, as shown in FIG. 7;

a control device M responsive to undervoltage, e.g. in control circuits, where the contact designated as CI stands for the undervoltage control, and a tripping device S similar to the one described previously, the tripper of which is controlled by an overcurrent detector I, by a detector Rth designed to detect mild protracted overcurrents, by a ground fault detector D responding to a fault in the conductors or in any equipment supplied by the line, whereas this fault detector may feature instantaneous or delayed, direct or differential action, etc . . . , and by a manual control device Ma.

In addition, by means of a mechanical or electrical coupling, the tripping device S can operate the auxiliary switch $K_1$ so as to cause the opening of the power supply circuit to the electromagnet coil in the automatic control device A, in order to confirm the switch opening caused by the tripping device S.

Likewise, detector $R_{th}$, ground fault detector D and control device M can each act in a similar way on auxiliary contacts $K_2$, $K_3$, $K_4$ in the power supply circuit to the coil B of electromagnet A.

FIG. 6 clearly shows that only the control device A and the undervoltage-sensitive control device M act directly on the mobile element 8 of the switch. This implies that the action of these control devices A and M must be powerful and fast enough to ensure proper switching. Conversely, control apparatus with sluggish and/or not powerful enough operation, such as detector $R_{th}$, ground fault detector D, overcurrent detector I, and manual control device Ma, operate through tripping device S.

Particular attention must be given to the functions $R_{th}$ and D. As mentioned above, these protections act on tripping device S through connections m and o respectively when the opening speed of C must be higher than that obtained by means of the direct control device. Quite obviously when the overloads monitored by $R_{th}$ and/or when the faults detected by D can be withstood for times distinctly higher than the direct control device's response time, the tripping device may not be necessary and in that case the abovementioned protections only act on auxiliary contacts $K_2$, $K_3$ through connections n and p respectively.

It should be pointed out that the invention is not restricted to a switch with a structure such as the one shown in FIGS. 1 to 6.

This switch could also comprise a mobile element holding many fixed contact unit/mobile contact unit couples, designed for normally open and/or normally closed operation.

Figure 8:
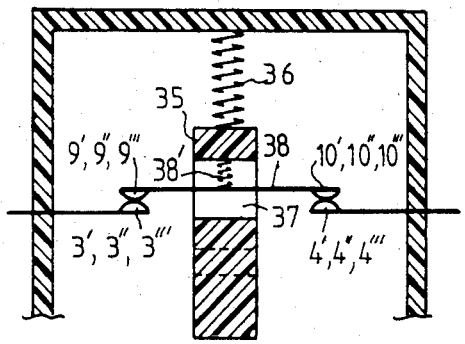
FIGS. 8 and 9 are diagrams of a switching device for three-phase circuits.
Figure 9:
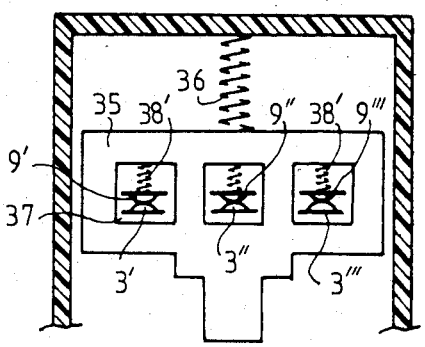

For instance, FIGS. 8 and 9 schematically show a switching device for three-phase circuits, which includes three couples of mobile contact units 9', 9'', 9'''-10', 10'', 10''', mounted on the same mobile element, cooperating with three corresponding couples of fixed contact units 3', 3'', 3'''-4', 4'', 4'''. In this example, the mobile element 35 which is, as before, pulled back by a spring 36, features three cavities or cages 37 through each one of which passes one mobile contact holder 38 carrying two mobile contacts 9'-10', 9''-10'', 9'''-10''', designed to meet two fixed contacts, respectively 3'-4', 3''-4'', 3'''-4'''. The bond between each of the mobile contact holders and the mobile element is ensured by a compression spring 38' acting in the same direction as spring 36.

As a result, the mobile element 35, which can be made of a light material to contribute to high breaking speeds, is maintained in its working position (closed switch position) by spring 36, whereas contact pressure is supplied by springs 38'.

Figure 10:
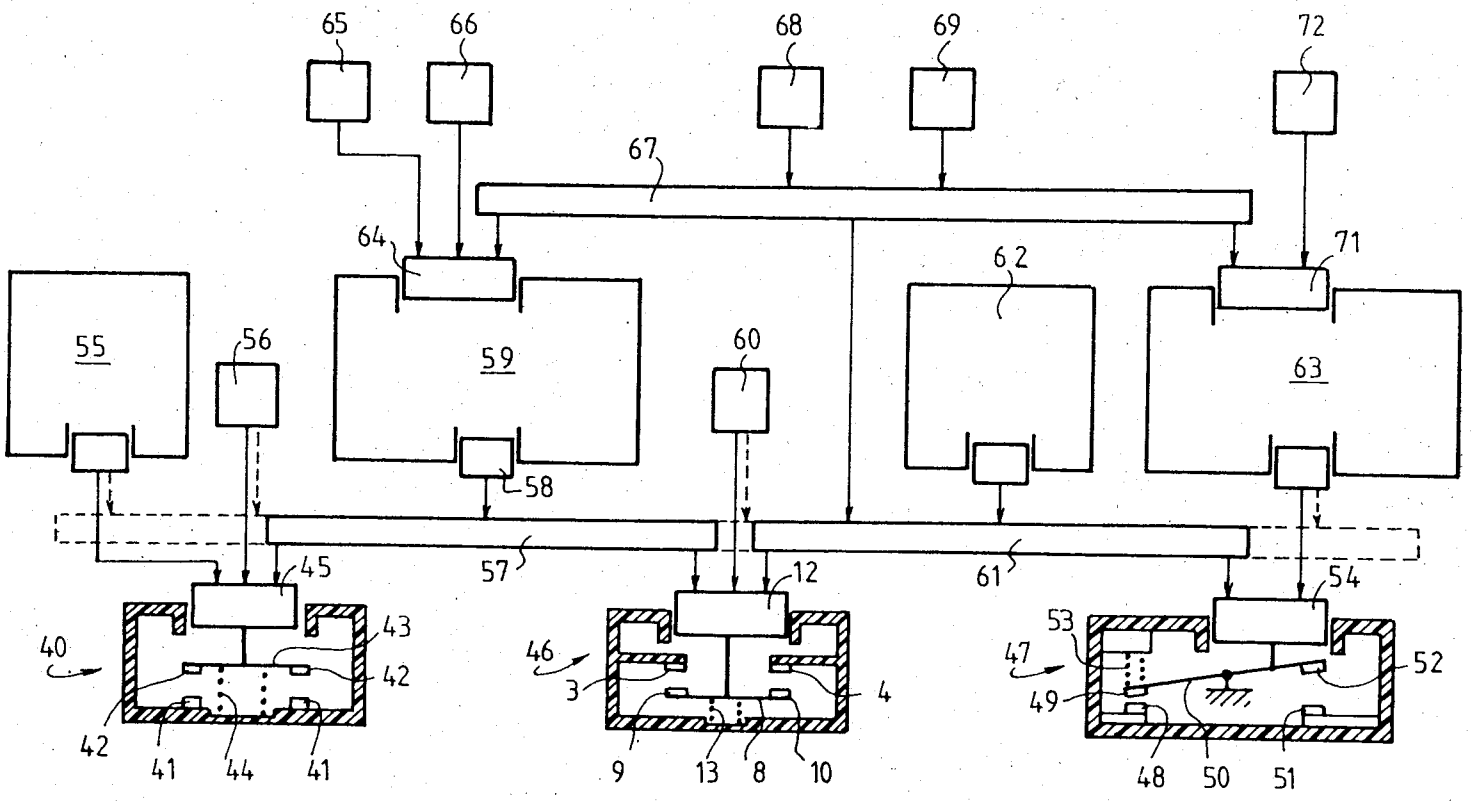
FIG. 10 is a block diagram intended to illustrate the multiple combination possibilities of the switching device designed in application of the invention.

FIG. 10 illustrates the multiple compositions that are possible for the switching device as a result of the invention.

This unit involves three controllable switches, i.e.:

one normally open switch 40, comprising at least two fixed contact units 41, at least two mobile contact units 42 carried on a mobile element 43 pulled open by spring 44, and a pushrod 45 rigidly bonded to the mobile element 43, a normally closed type switch 46, of a similar type to the one shown in FIG. 1 and involving at least two fixed contact units 3, 4, two mobile contact units 9, 10 carried by a mobile element 8 pulled in the closing direction by spring 13, and a pushrod 12 rigidly bonded to the mobile element 8, and a switch 47 with at least two inverse operation switches, i.e. a first contact made up of a fixed contact unit 48 and a mobile contact unit 49 assembled at one of the ends of an oscillating lever 50, and a second contact that involves a fixed contact unit 51 and a mobile contact unit 52 assembled at the other end of oscillating lever 50, whereas this oscillating lever is pulled on one side by a spring 53 which tends to ensure the opening of one of the contacts and the closure of the other, and solidly attached, at the other end, to an operating rod 54.

Switch 40 is controlled by an automatic control device 55, by an instantaneous-trip manual control device 56 and a transmission device 57 driven by the operating rod 58 of a tripping device 59 similar to the one described hereabove.

Switch 46 is controlled by a transmission device 57, by an instantaneous manual control device 60 and by a transmission device 61 driven specifically by an automatic control device 62.

To be satisfactory, automatic control devices 55 and 62 should be designed so as to have sufficient operating speed to ensure switching in normal load conditions (e.g. they may involve electromagnets).

Switch 47 is controlled by transmission device 61 and by a tripping device 63 similar to device 59.

The tripper 64 of tripping device 59 is controlled in turn by two control and/or protective devices 65, 66 and by a transmission device 67 driven by two control and/or protective devices 68, 69.

As for the operating mechanism 71 of tripping device 63, it is controlled by transmission device 67 and by a control and/or protective device 72 for instance.

Besides, transmission device 67 also acts on transmission device 61.

As an example, control and/or protective devices 65 and 66 may be a thermal protection device and a manual operation device respectively. Control devices 68 and 69 can consist in undervoltage relays, magnetic relays, etc . . . , which provide fast-action protections. In that case, device 72 may be a pneumatic, hydraulic, etc . . . pushrod, whatever its speed.

Of course, the invention is not restricted to the configuration described above, in the understanding that there are many possible combinations, which a professional can use to suit the specific problem in hand.

Thus pushrods 45, 12, 54 of switches 40, 46 and 47 can be linked together by a connecting bar—indicated in FIG. 10 by the interconnection of transmission devices 57 and 61 and by the extensions shown in dashed lines—in order to obtain simultaneous control of the three switches 40, 46 and 47, whatever the command.

Besides, this same connecting bar is designed so that it can be driven by automatic control devices 55, 62, by tripping devices 59, 63 and by manual fast-action control devices 56 and 60, which are shown joined by dashed lines.

Figure 11:
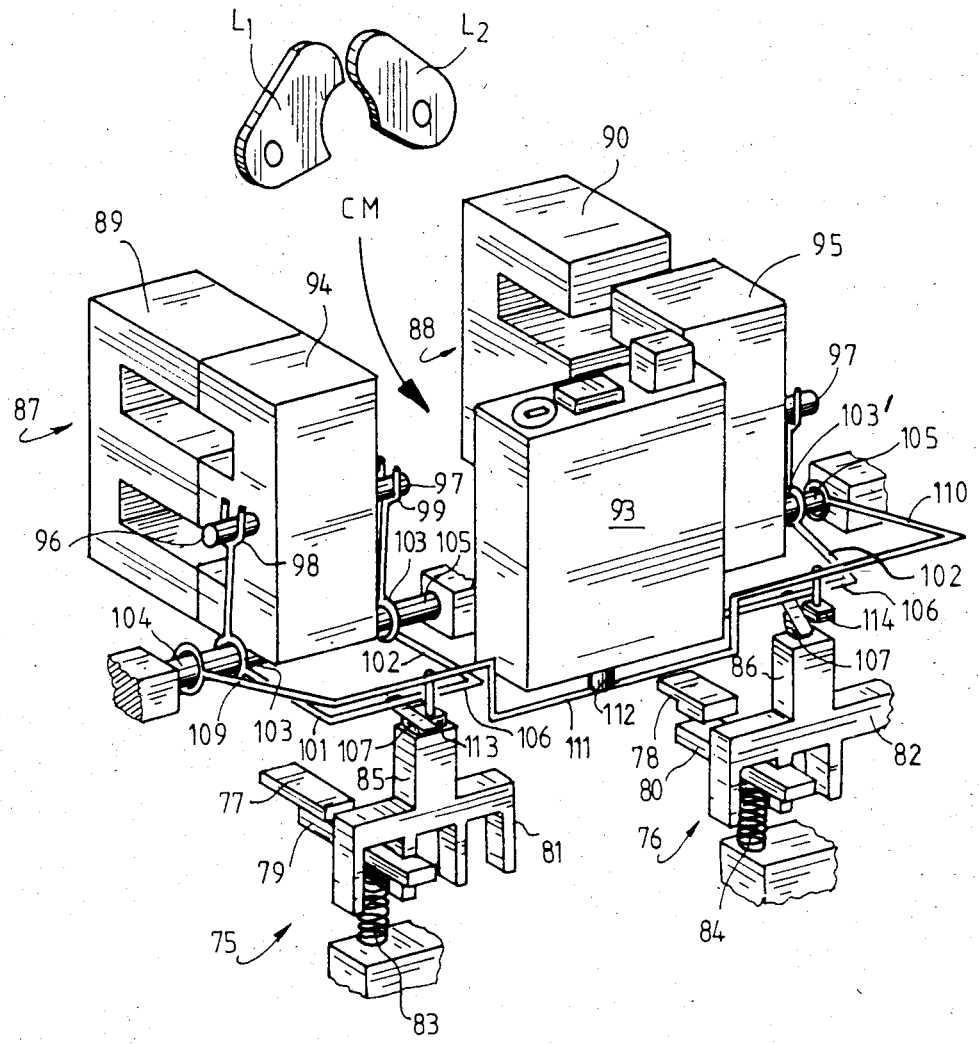
FIG. 11 is a blow-up showing a switching device assembled as a changeover switch.

As an example, FIG. 11 shows a switching device acting as a changeover switch. This implementation requires:

two normally closed type switches 75, 76, each comprising three couples of fixed contacts 77, 78 (only one of which is shown) cooperating with three matching couples of mobile contacts 79, 80 carried by mobile element 81, 82 restrained by a spring 83, 84 and fitted with a pushrod 85, 86, two automatic control devices, each one consisting in an electromagnet 87, 88 similar to those already described hereinabove, of which only the fixed armature 89, 90 and mobile armature 94, 95 have been drawn, and a tripping device such as the one already described, including appropriate control and protection devices for tripping operation.

In this example, the mobile armature 94, 95 of each of the electromagnets includes two lateral studs 96, 97 on which are geared the forked ends 98, 99 of an oscillating lever made of a U-shaped metal or plastic wire, the wings 101, 102 of which are folded at right angles in the middle forming a loop 103, 103' through which passes a hinge pin 104, 105. The middle 106 of this oscillating lever is fitterred with a shoe 107 matching one pushrod 85, 86 of the corresponding switch 75, 76. The operation of the two contactors formed by switches 75, 76 and electromagnets 87, 88, is identical to the operation described hereabove. However, to obtain the changeover function, the power supply circuit to the coils of both electromagnets 87, 88 is designed so that when one of the coils is energized, the other coil is at rest.

In the example shown in FIG. 11, electromagnet 87 is energized and therefore switch 75 is in its closed position. Conversely, electromagnet 88 is resting and holds switch 76 open.

In addition, a mechanical interlock device L1, L2 is provided with both electromagnets 87, 89; this device allows one of the electromagnets to be held open while the other one is closed.

In this example, tripping device 93 is designed to act on pushrods 85, 86 of switches 75, 76 through a transmission mechanism consisting in a U-shaped yoke, the tips of the arms 109, 110 of which bear on shafts 104 and 105, and the central section 111 of which features bearing pads 113, 114, matching pushrods 85, 86. The operating rod 112 of the tripping device 93 is designed so that it bears in the middle of the central section 111 of the yoke. As a result, during tripping, the operating rod 112 which moves into its extended position causes yoke 109, 110, 111 to tilt. As a consequence of the tilting, pushrod 85 of switch 75 which was in the closed position is suddenly repelled by the matching bearing pad 113, until switch 75 is fully opened. Conversely, switch 76 which was already open is not subjected to any strain. Whatever the state of excitation of electromagnets 87, 88, the switches will remain in the open position as long as tripping device 93 has not been reset.

The fact of associating a single tripping device 93 with the two automatic control devices 87, 88, is an obvious economical advantage, particularly considering that protection settings are identical to the setting required if the tripping device were associated with a single automatic control device, as for instance in the case of the control of a motor with only one operating direction.

A major advantage of the switching device complying with the invention is that it can be achieved by assembling an appropriate selection of modular components, i.e.:

at least one basic modular component incorporating the switching device described hereabove and, as required, at least one automatic modular control component incorporating an electromagnet and/or:

at least one fast-action modular control component including the tripping device described hereinabove and in addition if applicable one or several protection devices, and/or at least one modular protective component designed to act on the tripping device.

In this case, the modular automatic control, fast-switching control and protective components listed above are all provided with suitable means to enable them to be assembled together and on the basic component, as well as the electrical and mechanical bonding means required to ensure the electrical connections and the mechanical transmissions as described above.

Figure 12:
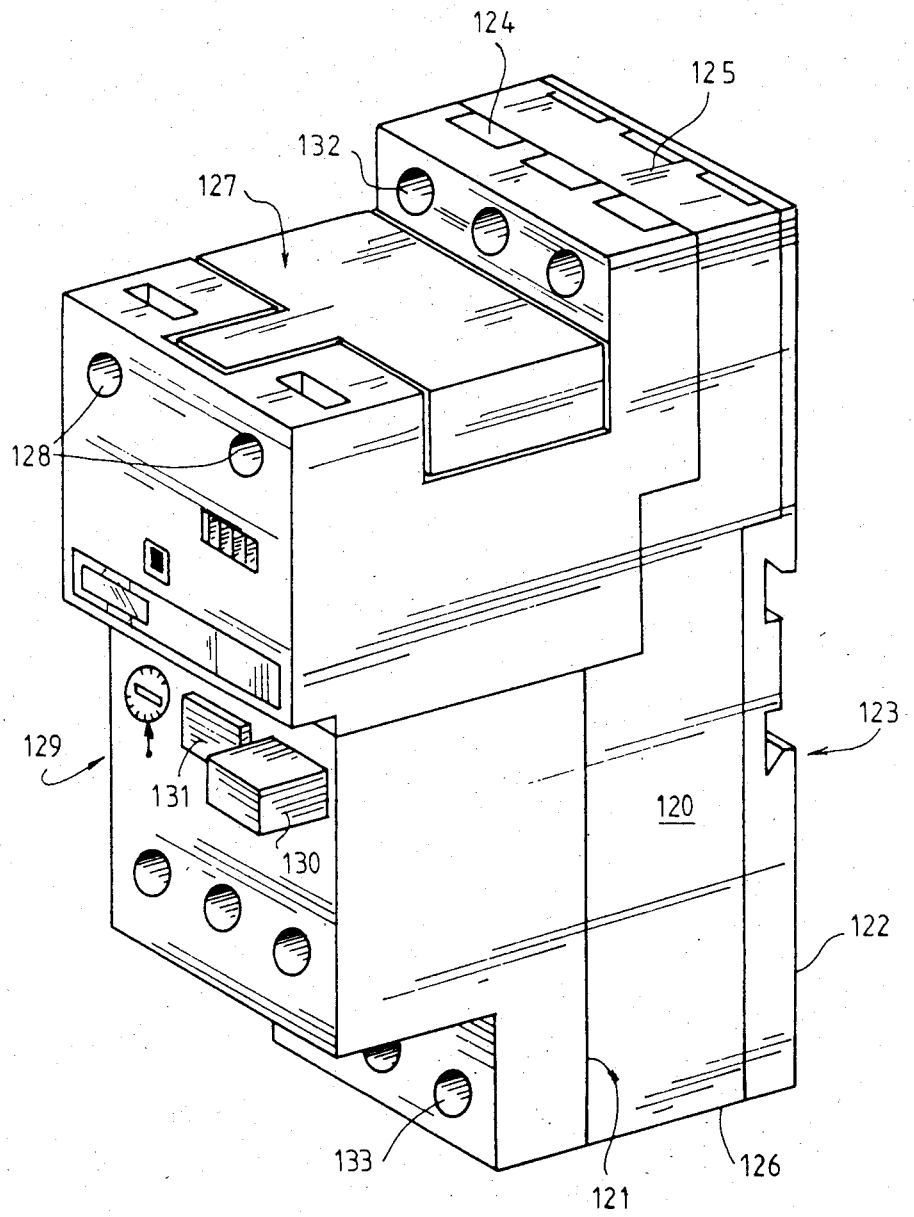
FIG. 12 shows a switching device built up with modular structure function blocks.

As an illustration, FIG. 12 shows a contactor similar to the one shown in FIG. 1 comprising:

a basic modular component 120, basically rectangular in shape, with a staggered front 121 designed to accomodate modular control and /or protection modules; and on the rear 122 a transversal cut-out 123, basically dovetail shaped, designed for conventional rail mounting; this basic modular component further comprises supply side connection leads 124 and load side connection leads, respectively provided on opposite ends 125, 126, a modular automatic control component 127 which assembles on the front 121 of basic module 120, at the source-side connection lead side; this module comprises a connection device 128 for the supply of the electromagnet coil, and a fast-switching modular control component 129, on which the reset button 130 and stop button 131 are visible.

In this example, modular components 127, 129 are fitted with holes 132, 133, to provide access to the source side and load side connectors 124 on the basic modular component 120.

What is claimed is:

1. A variable composition switching device comprising a set of modular components assembled together as required to ensure miscellaneous switching functions such as those usually associated with a switch, a contactor, a contactor with relay, the said assembly comprising:

(i) at least one basic modular component incorporating a controllable switching device, said controllable switching device including:

at least one fixed contact unit, a mobile element carrying at least one mobile contact unit, and able to move between a first position in which the mobile contact unit is in contact with the fixed contact unit, and a second position in which the mobile contact unit is separated from the fixed contact unit, elastic means exerting a pull on the mobile element that tends to force the latter to return to the said second position, and an operating rod, rigidly attached to the mobile element or part of same, this operating rod comprising at least one bearing surface upon which a control force antagonistic to the elastic means can be applied to cause the mobile element to move into the first position, and (ii) at least two types of modular control components with means assembled to the basic modular component, said modular control components comprising :

a modular direct swiching control component involving direct-action operating means, able to exert on the bearing surface of at least one basic modular component a fast enough control action with sufficient force to ensure proper switching operation;

one modular indirect switching control component involving operating means which, in response to a slow order, or one with insufficient energy to ensure proper switching, act on the bearing surface of at least one basic modular component by means of a potential energy accumulation tripping device, wherein said potential energy accumulation tripping device can take a set stable state and a tripped stable state, a setting transient phase and a tripping transient phase, said potential energy accumulation tripping device including:

actuating means that can successively take a stable tripped position in which it exerts an action antagonistic to that of the elastic means on the bearing surface of the operating rod of the switching device, to make sure that the mobile element is securely held in the first position, and a stable reset position in which the actuating means allows the mobile element to return to its second position;

potential energy accumulation means designed to store potential energy during the setting phase, and to restitute it as mechanical energy on the actuating means, and so to cause the mobile element to move from the second position to the first position during the tripping phase;

setting means involving at least one setting part upon which energy can be applied during the setting phase and a setting mechanism designed to apply the said energy to cause the actuating means to move from the tripped position to the set position, and simultaneously to transmit part of the said energy to the potential energy accumulation means, and a tripper involving at least one tripping part upon which at least one operating control action can be applied to generate the tripping phase, whereas this control action can be produced by one or several control and/or protection means designed to induce a sudden change of state in the controllable switching device.

2. A variable composition switching device as claimed in claim 1 involving at least one basic modular component, one modular direct switching control element and one modular indirect switching control element including a potential energy accumulation tripping device, wherein, when in the set state, the said tripping device enables the action of the modular direct switching control element and when in the tripped state it disables it.

3. A variable composition switching device as claimed in claim 1, wherein the said device comprises coupling means that enable the operating rods of at least two basic modular components assembled together to be rigidly attached, and the said modular direct switching control components and potential energy accumulation tripping device act on the said coupling means.

4. A variable composition switching device as claimed in claim 1, wherein the said device comprises a plurality of switching devices associated with a fast-action tripping device and a mechanical transmission device that ensures the coupling between the actuating means of the tripping device and the bearing surface of the operating rods of the said switching devices.

5. A variable composition switching device as claimed in claim 1, wherein at least one of the said modular direct switching control components consist in an automatic control device involving an electromagnet, the armature of which is coupled to an oscillating lever, one arm of which cooperates with the operating rod of at least one basic modular component, whether directly or through mechanical transmission means.

6. A variable composition switching device as claimed in claim 1, wherein the said device includes means for mechanical transmission of the control action from several modular direct switching control components to the bearing surface of the operating rod of a basic modular component.

7. A variable composition switching device as claimed in claim 1, wherein the tripper of the tripping device is linked to a plurality of control and/or protection means through mechanical transmission means.

8. A variable composition switching device as claimed in claim 1, wherein the setting part of the tripping device can be operated by hand.

9. A variable composition switching device as claimed in claim 1, wherein the said device comprises at least one pair of mobile and fixed contact units, each pair being able to act as a normally closed and/or normally open type switch.

10. A variable composition switching device as claimed in claim 1, said device comprising an automatic control electromagnet which acts on the bearing surface of the operating rod of at least one switch, and a tripping device the tripper of which is controlled by at least one detection device, the said tripping device including means to cause the opening of the power supply circuit of said electromagnet.

11. A variable composition switching device as claimed in claim 1, said device comprising an automatic control electromagnet able to act on the bearing surface of the operating rod of at least one switch, and at least one control and/or protection means also designed to act on the same bearing surface, wherein the said control and/or protection means includes means to cause the opening of the power supply circuit of said electromagnet.

12. A variable composition switching device as claimed in claim 10, wherein at least one of the detection devices that control the tripper of the tripping device comprises means to cause the opening of the power supply circuit of the electromagnet.

13. A variable composition switching device as claimed in claim 10, wherein the said detection device comprises means for detecting a small but protracted overcurrent, and/or ground fault detector means sensitive to a ground fault detected in the line or in any appliance supplied by the line and/or overcurrent detector means sensitive to short-circuits.

14. A variable composition switching device as claimed in claim 13, wherein the said detection device may act only on the power supply circuit of the electromagnet.

15. A variable composition switching device as claimed in claim 1, wherein the said device includes:

first and second switches, first and second electromagnets, each designed to act on the operating rod of the respective first and second switches, a power supply circuit designed to supply alternatively the first and second electromagnets, a tripping device designed to act on the operating rods of both the first and second switches through a transmission device.

16. A variable composition switching device as claimed in claim 15, wherein the said device comprises mechanical interlock means that enables the first electromagnet to be locked open while the second one is in the closed state, and conversely enables the second electromagnet to be locked open while the first one is closed.

17. A variable composition switching device as claimed in claim 15, wherein the tripping device respectively associated with the first and second electromagnets and with the first and second switches is identical to the tripping device that can be associated with a single electromagnet and a single switching device to act as an overcurrent relay of the same rating.

* * * * *